US009427654B2

(12) United States Patent
Schoenike

(10) Patent No.: US 9,427,654 B2
(45) Date of Patent: Aug. 30, 2016

(54) ICE SKATE BLADE GUARD WITH SAFETY FEATURE

(71) Applicant: Larry Schoenike, Sun Valley, ID (US)

(72) Inventor: Larry Schoenike, Sun Valley, ID (US)

( * ) Notice: Subject to any disclaimer, the term of this patent is extended or adjusted under 35 U.S.C. 154(b) by 0 days.

(21) Appl. No.: 14/722,115

(22) Filed: May 26, 2015

(65) Prior Publication Data

US 2015/0321071 A1 Nov. 12, 2015

Related U.S. Application Data

(63) Continuation-in-part of application No. 14/214,874, filed on Mar. 15, 2014, now Pat. No. 9,039,043.

(60) Provisional application No. 61/799,389, filed on Mar. 15, 2013.

(51) Int. Cl.
*A63C 3/12* (2006.01)

(52) U.S. Cl.
CPC ..... *A63C 3/12* (2013.01)

(58) Field of Classification Search
CPC ..... A63C 3/00; A63C 3/12; A63C 17/0006; A63C 17/002
USPC ..... 280/809, 811, 825
See application file for complete search history.

(56) References Cited

U.S. PATENT DOCUMENTS 30,627 A * 11/1860 Gibbs ..... A63C 3/12 280/825
2,154,735 A * 4/1939 Driscoll ..... A63C 3/12 280/825
2,187,629 A 1/1940 Rhoades et al.
4,252,345 A 2/1981 Cabral
D258,604 S 3/1981 Sholl
4,264,090 A 4/1981 Davies
4,365,828 A 12/1982 Hall et al.
4,382,615 A * 5/1983 Gronborg ..... A63C 3/12 280/825
4,382,616 A 5/1983 Olivieri
4,392,674 A 7/1983 Evon
4,546,999 A 10/1985 Lehr
4,673,196 A 6/1987 Hall
5,513,881 A * 5/1996 DiMeglio ..... A63C 3/12 280/825
5,941,568 A 8/1999 White
6,142,528 A 11/2000 Riley (Continued)

OTHER PUBLICATIONS

GUARDOG® commercially-available blade guards, at least as early as Jan. 2013.

*Primary Examiner* — John Walters
(74) *Attorney, Agent, or Firm* — Pedersen and Company, PLLC; Ken J. Pedersen; Barbara S. Pedersen

(57) ABSTRACT

An ice skate blade guard comprises a device for limiting/preventing falls and injury on the ice when skate blade guards are inadvertently left on when the skater goes onto the ice. At least one longitudinally-extending bar, blade, or other member provided on the bottom of the guard is sufficiently narrow, sharp, and/or with sharp or biting side edge(s) to bite-into the ice, upon incipient sideways movement, due to the member(s) being biased against the ice and/or due to weight of the wearer. The member(s) prevent sideways slipping, but allow forward movement. The slip-prevention member(s) may be movable in/on the guard and biased downward relative to the main body. In some versions, the slip-prevention blade(s) are fixed to the guard, rigidly and non-moveably protruding from the bottom of the guard.

23 Claims, 13 Drawing Sheets

(56) References Cited

U.S. PATENT DOCUMENTS

| | | | | |
|---|---|---|---|---|
| 6,666,479 | B1 * | 12/2003 | Maddaleni | A63C 3/12 280/825 |
| 7,070,522 | B2 | 7/2006 | Matwijw et al. | |
| 9,039,043 | B2 | 5/2015 | Schoenike | |
| 2003/0011150 | A1 | 1/2003 | Goldsmith et al. | |
| 2007/0013152 | A1 | 1/2007 | Goldsmith et al. | |
| 2007/0075540 | A1 | 4/2007 | Steinhauser | |
| 2007/0117687 | A1 | 5/2007 | Larson | |
| 2012/0013112 | A1 * | 1/2012 | Kapp | A63C 3/12 280/825 |

* cited by examiner

ICE SKATE BLADE GUARD WITH SAFETY FEATURE

This application is a continuation-in-part of U.S. Non-Provisional application Ser. No. 14/214,874, filed Mar. 15, 2014 and entitled "Ice Skate Blade Guard with Safety Feature", issuing on May 26, 2015 as U.S. Pat. No. 9,039,043, the entire disclosure of which is incorporated herein by this reference, and wherein Ser. No. 14/214,874 claims priority of U.S. Provisional Application Ser. No. 61/799,389, filed Mar. 15, 2013, and entitled "Ice Skate Blade Guard with Safety Feature".

BACKGROUND

1. Field of the Disclosure

The present invention relates generally to a device worn on an ice skate to partially enclose and/or otherwise protect the blade, and, more specifically, to such a device including a safety feature to limit or prevent falls if the skater enters the ice, that is, steps, glides, slides, jumps, or otherwise moves onto the ice, with the device still on the ice skate. The use of the preferred device would be recognized as extremely beneficial by ice skaters who have accidentally left their ice skate blade guards in place, and, upon entering the ice, have sustained a fall due to either undesirable type or direction of slippage of the blade guards upon the ice surface. Especially common are injuries sustained when one or both of the wearer's skates slide sideways out from under the wearer. Such injuries may be common, in part, because a skater frequently accelerates upon entering (moving onto) the ice by pushing his/her feet and skates in a direction having a vector transverse to the length of the skate blades.

2. Related Art

Ice skates and ice skate blade guards are well known. For example, see FIGS. 22 and 23, where an example, prior art ice skate S and an example blade guard BG (also "guard") are shown. As the blade guard BG of FIG. 23 may include an embodiment of the invented slip-prevention system, underneath the guard main body and not visible in this view, FIG. 23 is not labeled as prior art. The guards are used to protect ice skate blades B from damage or dulling, to prevent injury to persons coming in contact with sharp skate blades, and/or to protect floors and other surfaces upon which the skater walks. Also well-known is the fact that blade guards are designed to be worn by the skater only when not upon ice. For example, when a skater is waiting a turn to skate, the blade guards are installed upon the skates to protect the skate blades from damage by surfaces other than ice, such as wood or concrete surfaces. Some skaters also use the blade guards when they don their skates at a location distant from the ice, where-after they wear the skates and guards through a building or from a parking lot to the ice, for example.

If blade guards are not removed before entering the ice, serious injury may occur as the result of a fall because the blade guard interferes with the normal interaction between the skate blade and the ice and/or interfering with normal skating movements by the skater. This interference may depend on the material from which the guard is made, and may include "catching" of the guards on the ice as the skater tries to glide forward across the ice as he/she would typically do upon entering the ice, or, more frequently, slippage or other lack of control created because the broad, non-sharp base of many guards slides on the ice. Consistent with their original object and aim, conventional guards do not comprise the same shape, sharp edges, and/or material that a skate blade comprises, and so the guards seldom or never allow a skater to move on the ice in a controlled and safe way until the skater can remove the guards for leaving the ice or for carrying on with the intended skating.

The skate and blade guard main body shown in FIGS. 22 and 23 are only examples of many styles and types of skates and guards, as will be understood by those of skill in this field. There are many other styles of figure skates, and there are many styles of hockey and racing skates. Features common to many skates are a front "toe" T of the blade and a rear "heel" H of the blade, and openings O between the blade and the sole of the skate shoe. One or more of these features are typically used for connection of conventional blade guards to the skate/blade. For example, the front and rear portions of the guard BG main body shown in FIG. 24 slide apart longitudinally to receive and extend around the toe T and the heel H of the blade, whereafter the portions may be slid back together to capture the blade. Other guards may be somewhat flexible/bendable, so they can be pushed or pulled onto the blade and around the toe and heel. Other guards, for example ones enclosing only one of the toe T and heel H rather than both, will at least partially rely on structure extending through one or both openings O, or a loop over the heel H, to hold the guard on the blade. Therefore, many different skates and many different guards may be manufactured or retro-fit with embodiments of the invented safety mechanism.

The blade of an ice skate is configured to bite into ice during many movements. The blade may be slightly concave edge to edge, with sharp side edges (corners), and in some designs, slightly convex end to end. Many skating actions require the skater to be "on an edge", wherein an edge of the blade is "biting" or "cutting" into the ice while the skater's moves in a curved direction on the ice, wherein said "biting" or "cutting" provides control. One may easily see the effect of such biting or cutting, that is, corresponding marks on the ice that result because the skate blade cuts into, shaves, or gouges the ice, which is relatively softer than the metal skate blade.

Conventional ice skate blade guards, on the other hand, have broad bases, typically of rigid or generally rigid polymeric or rubber-like materials. Some bases have transverse channels across the base of the guard, for example, for cooperating with attachment means that connect to the skate. Some blade guards may be made of flexible or soft, even fabric, materials. Conventional guards, therefore, may be described as having bases for contacting the ground or floors that are broad and/or entirely or substantially non-sharp, for example, not having any edge or surface that is adapted to bite into the ice. Skate blade guards from the patent literature include: U.S. Pat. No. 4,252,345; Cabral, U.S. Pat. No. 4,264,090, Davies; U.S. Pat. No. 4,365,828, Hall, et. al.; U.S. Pat. No. 4,382,615, Gronborg, et. al; U.S. Pat. No. 4,382,616, Olivieri; U.S. Pat. No. 4,392,674, Evon; U.S. Pat. No. 4,546,999, Lehr; U.S. Pat. No. 4,673,196, Hall; U.S. Pat. No. 5,941,568, White II; U.S. Pat. No. 6,142,528, Riley; and U.S. Pat. No. 6,666,479, Maddaleni.

SUMMARY

The invented device and/or method comprise a guard that at least partially encloses, covers, and/or otherwise protects at least a portion of the blade of an ice skate, preferably the sharpened edges of the blade, and that is adapted to limit or prevent sideways-slip to minimize or prevent injury to the skater. The guard comprises a slip-prevention system comprising at least one element/member that limits or prevents sideways-slip on the ice, in case the guard is accidentally left installed upon the ice skate when the skater moves onto the ice (or "enters the ice"). The at least one element may comprise a longitudinally-extending bar, blade, protrusion, ridge, or other member that is adapted, for example, by being narrow, sharp, and/or having sharp side edge(s), to bite-into (cut into, grip, engage) or otherwise interact with the ice to limit or stop sideways motion. Urged against the ice by a bias and/or by weight of the wearer, the elongated element(s) is/are adapted to allow at least some safe forward movement, but to limit(s) or prevent(s) sideways slipping. The wearer is thus typically protected from falling until he/she may stop, and/or safely return to the rink-side, to remove the guards for skating if desired.

BRIEF DESCRIPTION OF THE DRAWINGS

FIGS. 34-36 are front views of bottom ends of three different example blades, wherein the longitudinal dimension of each blade extends into the paper, and wherein FIGS. 34-36 show some examples of different edge forming/sharpening, specifically:

FIG. 34 shows a blade that is sharpened to a single edge (extending into the paper) that is midway between the sides of the blade.

FIG. 35 shows a blade that is sharpened to an edge (extending into the paper) that is at one side of the blade.

FIG. 36 shows a blade that is sharpened to have two edges (extending into the paper), one at each side of the blade, with a concave "trough" between the two edges.

DESCRIPTION OF PREFERRED EMBODIMENTS

Figure 1:
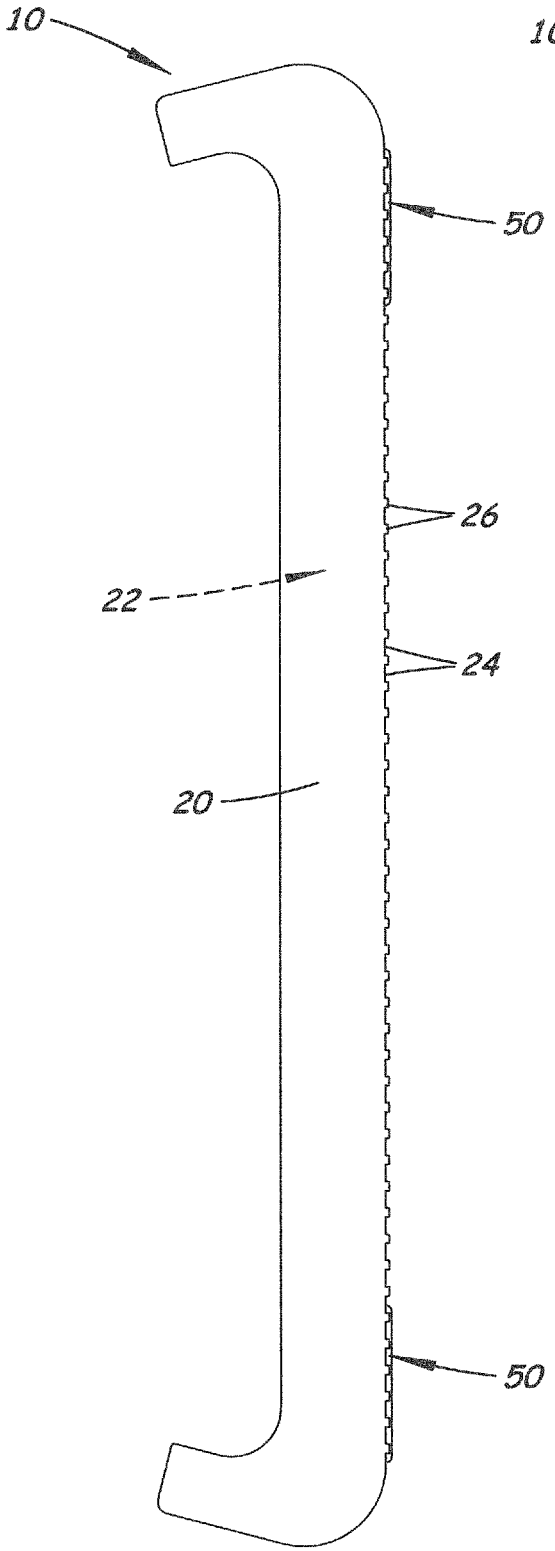
FIG. 1 is a side view of one embodiment of an improved ice skate blade guard that comprises an embodiment of the slip-prevention system, wherein dual-blade assemblies are installed near the toe-end and the heel-end of the guard.
Figure 2:
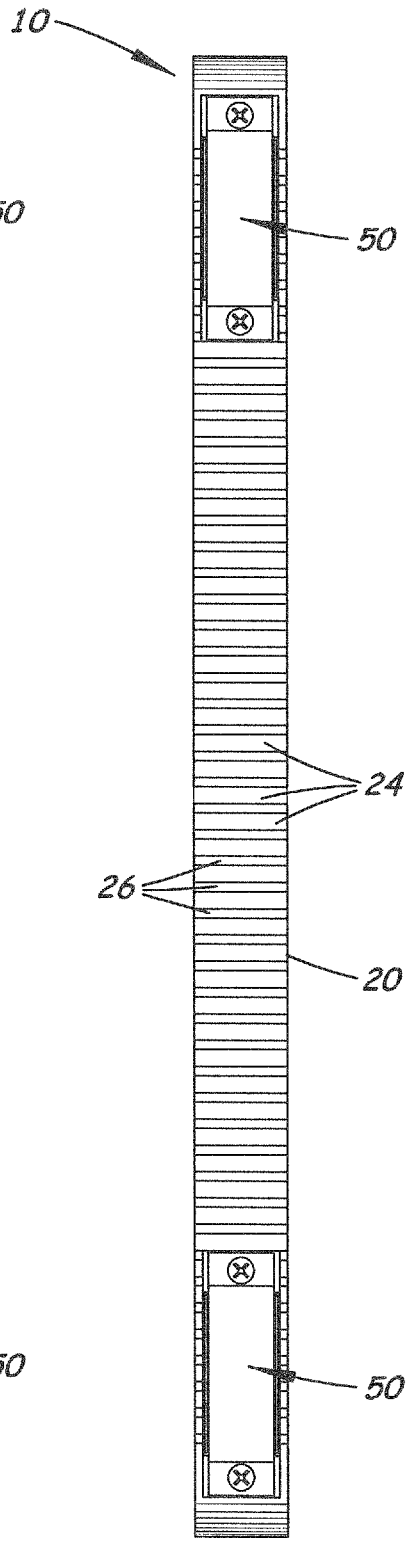
FIG. 2 is a bottom view of the guard of FIG. 1.

Certain embodiments of the invention may include a slip-prevention system for installation in/on a skate blade guard, a guard comprising the slip-prevention system, and/or methods of making or using an improved guard. The preferred embodiments of the invented slip-prevention system minimize or prevent injury to ice skaters who accidentally, or otherwise, leave their guards on their skates when moving onto the ice. Preferred embodiments are especially effective for preventing or limiting the side-ways slip-and-fall scenarios, but preferably are also effective for allowing smooth and safe forward sliding/motion of the skater for at least the time/distance it takes for the skater to realize the problem and stop safely or leave the ice.

The slip-prevention system may be manufactured or retrofit into guards of various conventional, or new, styles and structures that may be connected to a conventional skate by conventional means, as will be understood by those of skill in the art. Therefore, embodiments of the disclosed apparatus and methods may be used or adapted for many designs and styles of ice skates and blade guards, including ones not detailed or drawn herein.

Conventional ice skates each comprises a boot to be worn upon the foot of a skater, and, extending downwardly from the lower surface of said boot, an ice skate blade that may be inserted into or otherwise connected to a skate blade guard. The blade typically extends generally all along the length of the boot of the skate and may have a shape, curvature, and edges that are specially-constructed and sharpened, for example, for figure skating, ice-hockey, or racing.

Conventional guards have been made of many different shapes and compositions and with many different attachment systems. For example, conventional guards may be made of one or more pieces, with one or more fasteners, straps, or elastic members, and/or be adapted to remain on a skate blade by virtue of a flexible and resilient pocket structure for receiving the skate blade. Importantly, most conventional guards comprise broad, smooth or otherwise non-sharp, and, in some versions soft or flexible, bottom surfaces ("base surfaces") that are not constructed for, or capable of, normal skating motions. Conventional skate guards are not intended to be used on ice, and do not provide safe and effective control of movement on ice.

Guards with firm, substantially rigid, or rigid guard main bodies that are quite securely connected to the skate/blade are especially-preferred for the slip-prevention systems herein disclosed, because such guards will house and cooperate well with various embodiments of the slip-prevention system. Also, such guards will transfer force from the foot/skate/blade to the slip-prevention system and, hence, to the ice for good control of movement on the ice, rather than the guard merely popping, sliding, or pivoting off of the skate. Also, such guards may be preferred for biased slip-prevention systems, as such systems may comprise a spring that requires a rigid surface against which to push against or by which to be anchored. Two of many example blade guards, with which certain embodiments may be used, are GUARDOG™ blade guards or A & R™ Hockey Blade-guards.

Preferred embodiments of the slip-prevention system comprise at least one elongated member positioned at or near the bottom of the guard main body and orientated parallel to the length of the main body and of the skate blade. The at least one member may be, for example, a bar, blade, ridge, or protrusion, a "mini-blade", "side-slip-stop", or "edge-grip member" that is narrow, sharp, or has at least one edge that is sharp enough, and that is positioned and/or biased to be exposed enough, to bite into (gouge, cut, shave) the ice to stop sideways movement upon application of force in the sideways/transverse direction. The slip-prevention member(s) are preferably harder than ice. It is preferred that the portion of the slip-prevention system protruding from the guard is longitudinally smooth, for example, without transversely-protruding ridges or texture, at least to an extent that allows the wearer to glide/slide forward at least a few feet without the guards "catching" and the wearer falling forward. Due to their narrowness and/or sharpness and hardness relative to the ice, the slip-prevention member(s) may cut into the ice to some extent while gliding forward on the ice; this may leave "tracings" and other marks in the ice, but should not stop the skater from forward movement, as the elongated member will glide smoothly with its length parallel to the direction of gliding.

In certain embodiments, said at least one elongated member is movably mounted in, and biased out from, the main body of the guard. The movable member(s) may be slidable relative to the guard main body, so that, if the main body is horizontal, the movable member(s) may be described as slidable upward and downward and as biased downward. The bias ensures that the at least one elongated member, even after some wear and tear, is forced against the ice when the wearer mistakenly enters the ice. As mentioned above, the longitudinally smooth blade portion protruding down from the main body of the guard should allow the wearer to glide/slide forward at least a few feet without the guards "catching" and the wearer tripping or falling forward. The longitudinally smooth blade portion may cut into the ice to some extent while gliding forward on the ice, but not to an extent or in a direction that will suddenly stop or trip-up the forward motion.

In alternative embodiments, the slip-prevention system is non-moveably installed on/in the guard, for example, without any slidable or other movement relative to the guard and without any bias means. The immovable/un-biased member(s) is placed and sized so that it/they protrude(s) beyond the guard plane GP, so that the lowermost extremity(ies) of the member(s) bite into the ice when the skate/guard starts to slide sideways. As mentioned above, the longitudinally smooth portion protruding down from the main body of the guard should allow the wearer to glide/slide forward a few feet without the guards "catching" and the wearer tripping/falling forward. The longitudinally smooth portion may cut into the ice to some extent while gliding forward on the ice, but not to an extent or in a direction that will suddenly stop or trip-up the forward motion.

During movement on a non-ice surface, such as a floor, pavement, or sidewalk, the slip-prevention system tends not to interfere with walking and normal movement. The system will preferably be strong and durable enough that wear and tear on the system, by very hard or abrasive surfaces, will be minimal or at least slow. Slip-prevention members(s) that are installed in the guard by means of a biased, slidable mounting may slide to some extent up into the main body, for easier walking on uneven surfaces, and for possible reduction of wear of the member(s). Certain slip-prevention systems may not be optimal for walking on a delicate floor, but the skater may normally avoid such surfaces.

In embodiments with bias, the bias may be determined without undue experimentation, and expected to range from a bias that forces one or more narrow/sharp blades to bite into the ice surface even when portions of the guard bottom surface rest on the ice to support (carry) much or most, or nearly all, of the weight of the user and the skate-plus-guard, to a bias that is strong enough to carry the entire weight of the user and the skate-plus-guard and so lift the guard main body (and, hence, the skate and wearer) up off the ice.

In certain embodiments, the one or more slip-prevention member(s) extend(s) only part way along the main body of the guard, resulting in the bottom of the guard being substantially a conventional guard base and only partly being a base adapted by the slip-prevention member(s). For example, multiple slip-prevention members may be spaced along the length of the guard main body. Alternatively, the slip-prevention member(s) may extend(s) most or all of the way along the length of the main body of the guard. In certain embodiments, two of the slip-prevention members are provided, for example, one near the front (toe) end of the main body and one near the rear (heel) end of the main body. In alternatively embodiments, more than two slip-prevention members are spaced along the length of the main body. It will be understood from this document and the drawings, that slip-prevention adaptations are preferably installed in at least at front and rear positions on the guard to prevent sideways slipping of the entire guard, rather than just the toe or the heel end. Also, in less-preferred embodiments wherein it is desired to lift the main body and skate and wearer up off the ice, slip-prevention adaptations also will typically be installed at least at front and rear positions on the guard, in order to lift the entire guard/skate/wearer. Said installation at least at the front and rear may include a continuous, long, slip-prevention system extending along most or all of the guard. Thus, in certain embodiments, contact with the ice of various portions of the guard main body and the slip-prevention system may depend on the size, shape, and rigidity/flexibility of the guard; the size, shape, location, and bias if any, of the slip-prevention system; and the position and/or tilt of the wearer's foot and skate (and therefore the guard and slip-prevention) relative to the ice at any given moment, and that these variables may be taken into account by one of skill in the art after viewing this document and the drawings.

Certain of the slip-prevention members may comprise two or more blades placed side-by-side or transversely-adjacent on/in the bottom of the guard, as such systems, in effect, provide slip-prevention at or near opposite side edges (right and left) of the guard main body. An especially-preferred embodiment comprises a dual-blade unit that has two parallel, side-by-side, spaced-apart, depending blades that are each much smaller in width (transverse to the length of the guard) compared to their length and depth dimensions. The front ends of the two blades typically extend forward to the same extent and the rear ends of the two blades typically extend rearward to the same extent. The blades, or at least their lowermost extremities, may be spaced apart by 50-120 percent of the width of the bottom of the guard, for example. More preferably, the blades are spaced apart by about 70-95 percent of the width of the bottom surface of the guard, so a portion of the guard main body extends outside and along the blades, for reinforcing or retaining the blades on the guard and in a recess, and helping prevent the blades of the guard on one skate/foot from catching on the blades of the other skate/foot. While these and certain other embodiments may be described as slip-prevention "blades", as they cut into the ice, the preferred slip-prevention blades are not conventional skate blades, and preferably are thinner (narrower) and shorter than conventional skate blades, and in some embodiments, are not concave from right to left, and in some embodiments have a single sharp edge but not sharp right and left edges.

Referring Specifically to the Figures

In the Figures, there are shown several, but not the only, embodiments of the invented slip-prevention system, ice skate blade guard devices incorporating the system, and methods of use. Guard 10 comprises main body 20, which includes an interior longitudinal space 22 which receives the skate blade, and which is adapted for slip-prevention as described herein. Main body 20 comprises transverse channels 24 recessed into its bottom surface or "base". While there might be some curvature and ridges in the bottom surface of the guard, the bottom surface of the guard (right-most in FIG. 1 and downward in FIGS. 3-5) may be said to have a bottommost extremity lying on a bottom guard plane GP. The guard plane GP that is typically horizontal near/around each slip-prevention element/member, when that portion of the guard is pressed against the floor/pavement/ice. See guard plane GP, in FIGS. 3 and 4, which is co-planar with the distal extremities of ridges 26 extending downward on each side of the channels 24.

Front and rear slip-prevention systems 50 are provided near the toe and heel of the main body 20 of the guard, with the duel-blade unit 56 of each being biased downward from the main body of the guard. Each slip-prevention system 50 (also "dual-blade assembly") comprises a retainer bracket 54, a mini-blade unit (also, "dual-blade unit") 56, and fastener structure for connecting the system 50 to the main body. The unit 56 is recessed into a space 52 formed/cut into the main body 20. The retainer bracket 54 extends underneath the mini-blade unit 56 and the combination is held in the space 52 by bolts 58 that threadably connect to nut-serts 60 retained in the main body. The retainer bracket 54 includes portions that may be called a main plate 55, for being underneath the slip-prevention unit 56, and wings 57, for extending beyond each end of the unit 56 for fastening into the main body 20 on each end of the space 52.

Figure 6:
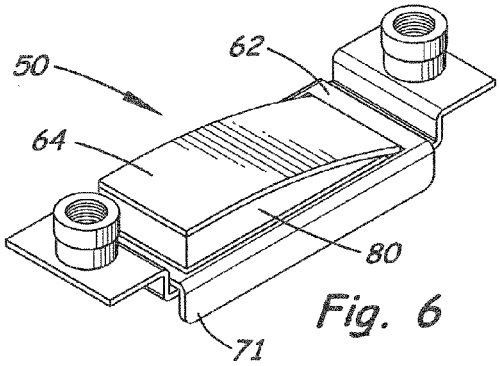
FIG. 6 is a top perspective view of the dual blade assembly of FIGS. 1-5, detached from the guard and showing one embodiment of the bias-cushion used in addition to the bias-spring of the assembly.
Figure 7:
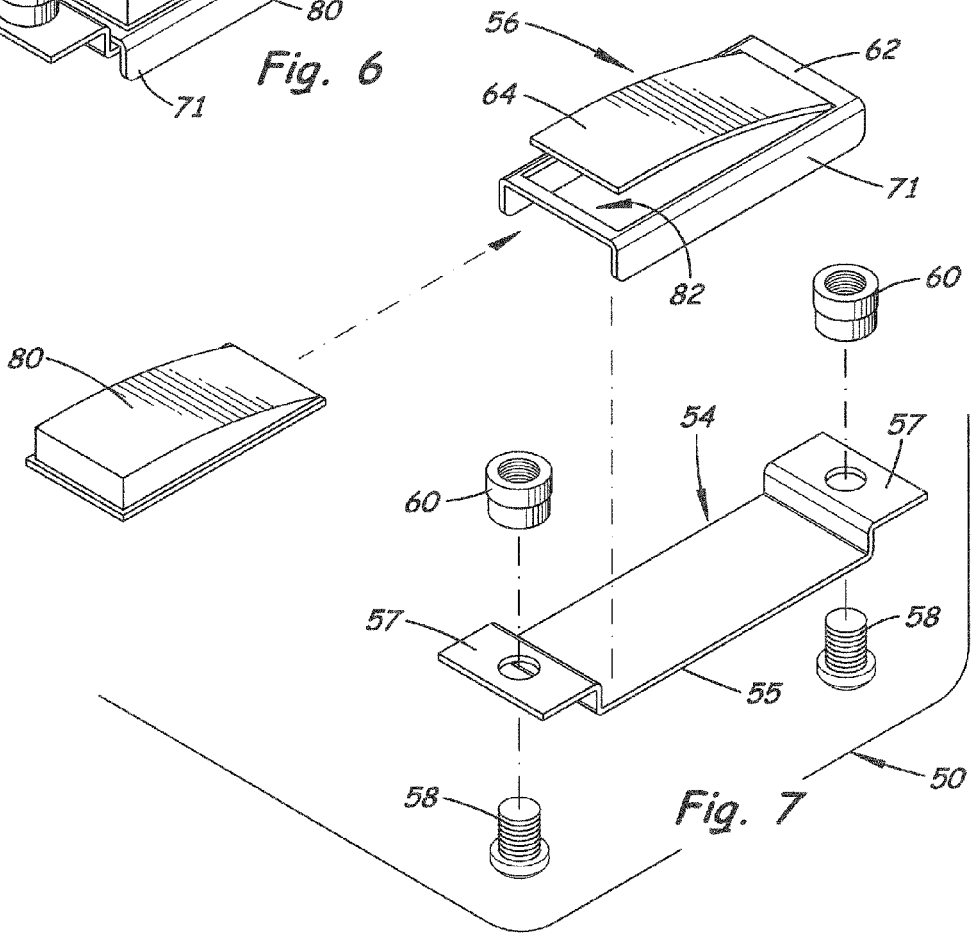
FIG. 7 is an exploded top perspective view of the pieces-parts of the dual-blade assembly of FIGS. 1-6.
Figure 8:
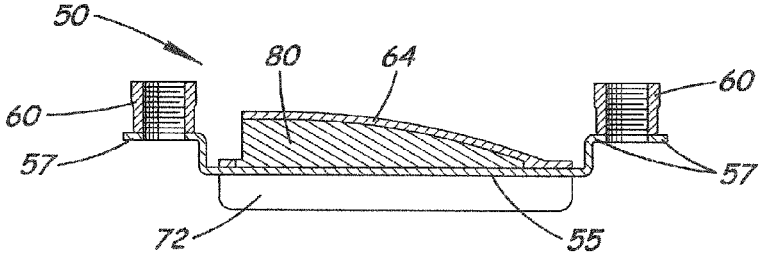
FIG. 8 is a cross-sectional side view of the dual-blade assembly of FIGS. 1-7.

The unit 56 comprises a top plate 62 and two downwardly-extending slip-prevention blades 71, 72, one at each side (right and left) of the top plate 62. A spring member 64, such as a leaf-spring, protrudes up from the top plate 62 for pressing against the top surface 70 of the space 52 and biasing the unit 56 downward relative to the main body 20. A bias-pad or other firm cushion 80 may be inserted into the unit 56, to further bias the unit 56 downward in the space 52, and/or to stabilize the unit 56 in the space 52, for example, to prevent the unit 56 from jiggling or rattling. For example, the cushion 80, as shown in FIGS. 6 and 7, may rest on the main plate 55 and extend through the aperture 82 in the top plate 62, filling or substantially filling the space between the retainer bracket main plate 55 and the bottom surface of the spring member 64. Alternatively, the cushion could rest on top of the top plate 62 and fill/substantially-fill the space between the top plate 62 and the bottom surface of the spring member 64.

The unit 56 is held from falling out of the space 52, by retainer bracket 54, but it can and preferably does slide upward and downward in the space 52. The downward bias on the unit 56, and therefore its blades 71, 72, is created by the spring member 64 and preferably also by the cushion 80. Other bias systems, such as other springs and/or other cushions, spring(s) alone, of cushion(s) alone, may be used. Further, the spring(s) or other bias members may not be fixed or secured to the blade-unit, but rather may be loose or otherwise provided in the space 52, or may be fixed/secured to a wall(s) of the guard main body rather than being fixed/secured to the blade unit. In unattached-bias-member embodiments, the bias member(s) may be retained from falling out of the space simply by the blade unit and/or the retainer bracket and/or other structure. Other means of slidably/movably retaining the slip-prevention unit in the guard are envisioned by the inventor.

Blades 71, 72 of the dual-blade unit 56 have lowermost extremities 73, 75 on blade plane BP, below guard plane GP. Thus, while blade plane BP may be said to be parallel to, and "generally near" to, the guard plane GP, it should be at least slightly lower than the guard plane GP to bite into the ice at least in a sideways direction. During forward movement, the dual-blade unit may "cut" into the ice, such as would leave "tracings" or other marks on the ice, but will glide forward sufficiently smoothly, to not stop or trip-up the skater, until the skater can safely stop or leave the ice. See particularly FIG. 9A, illustrating the blade plane BP at the lowermost extremities of the blades 71, 72 (where they are cuttomg into the ice), and also illustrating the guard plane GP (bottom of the guard main body) and the ice plane (top of the ice) that are typically and preferably the same or generally the same plane because the main body rests on the top of the ice.

The lowermost extremities 73, 75 of the dual-blade unit may be various distances from the guard plane GP, as long as they protrude sufficiently beyond the guard plane GP to bite into the ice at least in response to incipient sideways motion. Said various distances may correspond to blades 71, 72 or other slip-prevention blade(s) protruding beyond the guard plane GP, for example, a distance in the range of 1/64-1 inch, 1/32-1 inch or 1/16-1 inch, or more preferably, 1/64-1/4 inch, 1/32-1/4 inch, 1/32-1/16, or about 1/16 inch, for example. In many embodiments wherein the blade unit(s)/blade(s) are movable and biased, the distance blade(s) protrude beyond the guard plane GP will depend on whether weight is on the guard and the blade unit(s)/blade(s); preferably, with weight on the guard and the blade unit(s)/blade(s), the slip-prevention blade(s) will protrude beyond the guard plane GP and cut into the ice (as shown in FIG. 9A) a distance in the range of 1/64-1/4, 1/32-1/4, 1/32-1/16 inch, or about 1/16 inch. In many embodiments wherein the slip-prevention blade(s) are not movable, the slip-prevention blade(s) will protrude beyond the guard plane GP and cut into the ice a distance in the range of 1/64-1/2, 1/64-1/4, 1/32-1/4, 1/32-1/16 inch, or about 1/16 inch, for example.

Figure 9B:
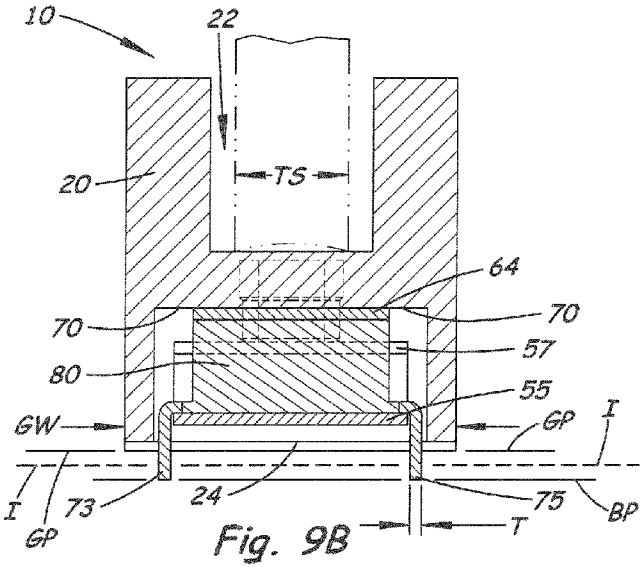
FIG. 9B is an enlarged end view of an alternative embodiment wherein the bias is adapted to be so forceful so that the blades, shown biting into the ice, carry the guard, skate, and wearer above the plane of the top surface of the ice, and limit/prevent sideways movement.
Figure 9A:
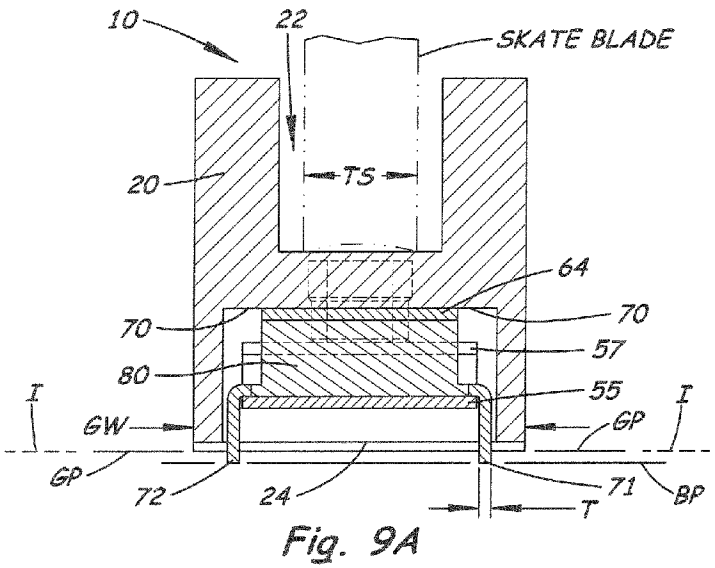
FIG. 9A is an end view along the line 5-5 in FIG. 4, as in FIG. 5 except enlarged for convenience in calling-out portions of the dual-blade assembly as installed in the main body of the guard and calling-out the blade plane, guard plane, and ice plane.
Figure 10:
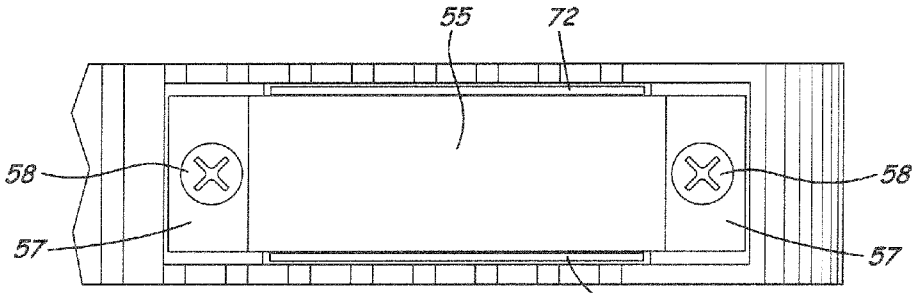
FIG. 10 is an enlarged bottom view of one end of the embodiment of FIGS. 1 and 2, again for convenience in calling-out portions of the dual-blade assembly as installed in the main body of the guard.
Figure 34:
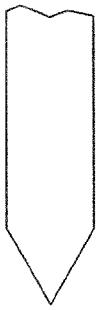
Figure 35:
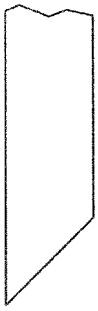
Figure 36:
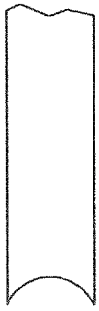

One may see to better advantage details of the embodiments of FIGS. 1-8 in enlarged FIGS. 9A and 10. Note that, in certain embodiments, the thickness T (left to right as the blades are drawn in FIG. 9A) of each of the blades 71, 72 is very small (narrow) compared to the thickness of the example skate blade TS. This thinness and the preferred rigidity of each blade 71, 72 adapts the blades 71, 72 well for quickly biting-into the ice against sideways-motion when the blades 71, 72 are pressed against the ice. The blades 71, 72 bottom edges (corners) may be, for example, 90 degree edges/corners or other angles of edges/corners, or, in alternative embodiments, the extremities may be sharpened to a single edge, or multiple edges, for example, a "knife edge" or "concave edges", such as illustrated in FIGS. 34-36. Especially-preferred embodiments are sharp enough (either a single edge or right and left edges or concave edges) to bite into the ice but not so sharp as to easily cut human skin. Examples of the thickness T of each blade may be in the range of 0.1-10 mm, 0.2-4 mm, or about 0.5-2.5 mm, about 1-2 mm, for example, while the typical skate blade may have a thickness TS of about 5 mm or more. In certain embodiments, T may be less than the thickness of ice skate blades, half of the thickness of ice skate blades, or less than 1/4 of the thickness of ice skate blades. The blades 71, 72 in the embodiment shown in the Figures may be about 4-8 cm long, for example, and spaced apart almost as far as the main body of the guard is wide. The blades 71, 72, and the entire slip-prevention unit may be stainless steel, for example or other water and wear-resistant material(s). The blades 71, 72 are preferably rigid, and non-bending, and non-compressible.

Figure 3:
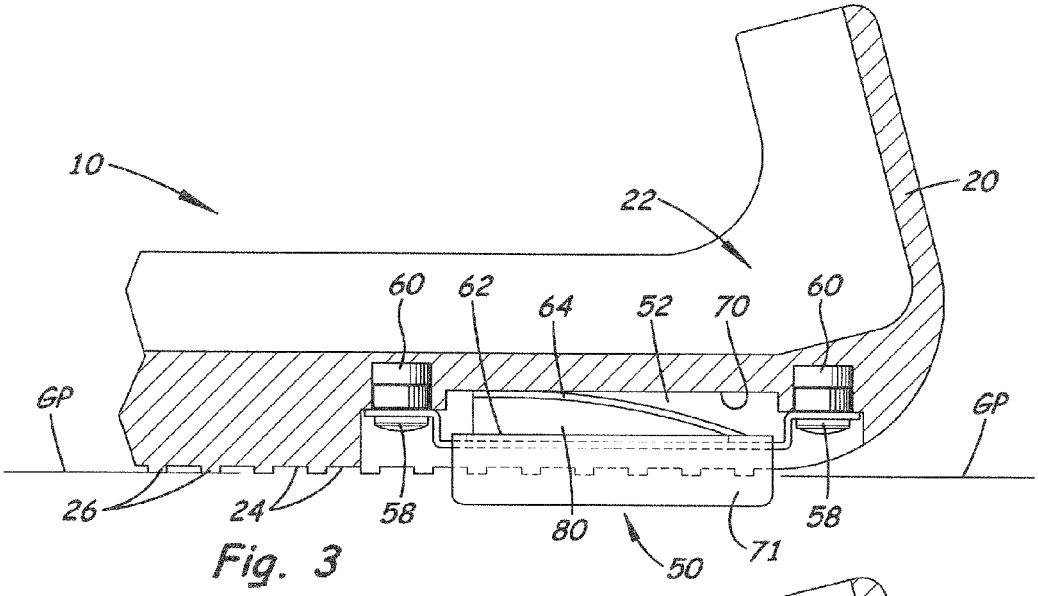
FIG. 3 is a longitudinal, cross-sectional, partial side view of the guard of FIGS. 1 and 2, for example the toe-end, showing in detail a dual-blade assembly of FIGS. 1 and 2. No weight is being placed on the guard, as if the wearer has raised his/her foot up from the floor/ground/ice.
Figure 4:
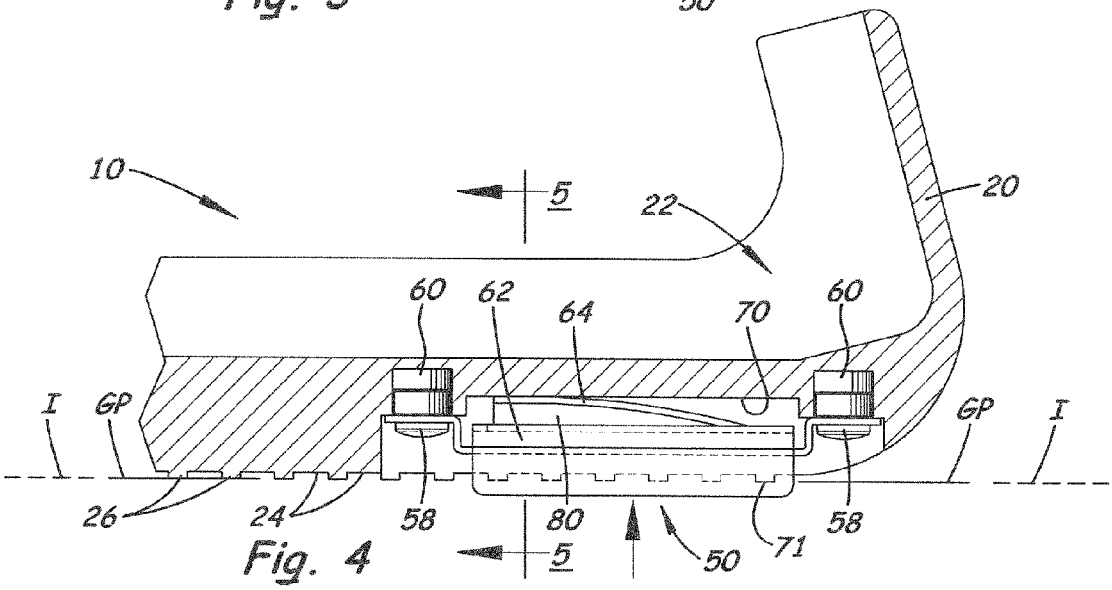
FIG. 4 is a cross-sectional, partial view of the guard of FIGS. 1 and 2, as in FIG. 3 except that the wearer has put his/her foot down on ice, so that the guard main body rests on the ice, and the dual-blade unit is biased down from the guard main body to be pressed against/into the ice. The dual-blade unit has moved slightly up into the guard main body due to being pressed against/into the ice, but the bias still forces the dual-blade unit below the guard main body to bite into the ice sufficiently to limit/prevent sideways movement when sideways force is applied to the skate and guard, that is, when incipient sideways movement occurs/begins.
Figure 5:
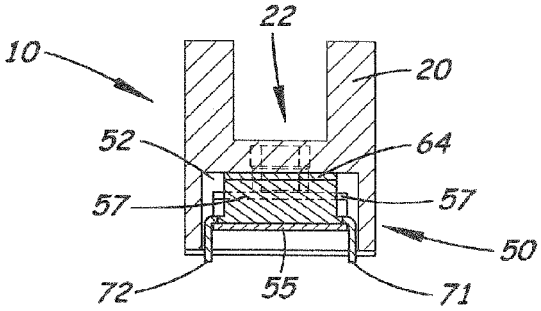
FIG. 5 is a cross-sectional end view along the line 5-5 in FIG. 4.

When the skate and guard 10 are lifted up, as in FIG. 3, the dual-blade unit 56 is urged by the bias so that the blades 71, 72 protrude significantly down from the bottom of the guard (guard plane GP). When the wearer steps on the ice, however, the wearer's weight on the guard pushes the dual-blade unit upward a certain extent, as shown by the changing positions of the blade 71 and the spring 64 in FIG. 4 compared to FIG. 3. In FIG. 4 and FIG. 5, and enlarged FIG. 9A, the guard is shown on the ice (dashed line ice plane I) with the bottom of the guard main body (guard plane GP) resting on the ice (ice plane I), and the dual-blade assembly biased downward from the main body so that the lower extremities of the blades 71, 72 bite into the ice to be lower than the guard plane GP (solid line plane) and the top surface of the ice (dashed ice plane I). This way, the guard supports most, or nearly all, of the weight of the wearer on the ice, with the blades 71, 72 biting/digging into the ice a millimeter up to several millimeters, for example.

In FIG. 9B, an alternative embodiment is shown that is constructed very similarly to that in FIG. 9A, except that the total spring/bias force of the two dual-blade assemblies is so strong that the weight of the wearer (with skates and guard) is supported on the blade lower extremities 73, 75, and the guard main body is lifted above the ice. Thus, the blade plane BP of the lower extremities 73, 75, which are biting into the ice, are shown slightly lower than the top surface of the ice (ice plane I, dashed line), and the guard plane GP is above the ice plane I. The blades cut into the ice a millimeter up to several millimeters, for example, but the ice at that point supports the blades and the highly-biased blades support the guard, skate and wearer.

The thickness T of the blades in FIGS. 9A and B is much smaller than the thickness/width of the guard, and especially much smaller than the thickness/width GW at or near the bottom surface of the guard. For example, the thickness T of each blade may be less than 1/5, less than 1/10, less than 1/20, 1/5-1/50, 1/5-1/20, 1/10-1/50, or 1/10-1/20, of width GW.

The thickness T of each blade and the length of each blade will typically be such that the total bottom surface area (or lowermost extremity surface area) of all the blades will total to be much less than the bottom surface area of the main body of the guard. For example, the total bottom surface area of the blades may be less than three square inches, or less than 2 square inches, or less than 1 square inch, while the total bottom surface area of the main body of the guard may be in the range of about 7-20 square inches, and more typically 10-15 square inches. Thus, in many embodiments, the ratio of guard bottom surface area contacting the ice to blade bottom surface area (or lowermost extremity surface area) touching the ice may be 7 up to 20, or even higher, for example.

As described above, in certain embodiments, the guard main body will rest on the ice while the slip-prevention blades are biased downward to bite into the ice sufficiently to perform the desired function. In other words, the inventor believes that a total spring/bias force less than the total weight of the wearer, skate, and guard may be effective in certain embodiments in urging the blade bottom ends (lowermost extremities 73, 75) into the ice sufficiently to accomplish the desired slip prevention while not lifting the entire main body of the guard main body (with the skate and the wearer) up off the ice. For example, the inventor expects that a total spring/bias force of about 40-100 pounds may be acceptable, wherein the lower end of the range could be used for smaller/lighter people and the higher end of the range could be used for larger/heavier people, for example. In certain embodiments, a total spring/bias force of 40-60 pounds or about 50 pounds is expected to be effective for many skaters; this would allow for only one or a few differently-biased guards to be made to fit and work for many different sizes and ages of people.

In other embodiments, the slip-prevention units/systems support all of the total weight of the wearer, skate and guard, hence, lifting the wearer, skate and guard main body up off the ice. In such embodiments, the bias/spring strength would need to be substantially greater than in embodiments wherein the guard or portions of the guard also rest on the ice and/or such embodiments would be applicable to light-weight wearers.

The pressure (pounds per square inch) exerted on the ice by the blades 71, 72 will depend on the surface area of the blades touching the ice. One may note from the drawings that the surface area of the bottom surfaces of the blades is intentionally very small in many embodiments, for example, less than three square inches, or less than 2 square inches, or less than 1 square inch, of total slip-prevention blade surface area. The resulting pounds per square inch will be fairly large (for example, 40-60 pounds force total per 1 square inch total surface area) and this is expected to be effective in many, but not necessarily all, cases for slip-prevention. In embodiments wherein the guard, skate and wearer are lifted up off the ice by the slip-prevention blades, the pounds per square inch on the blade extremities will typically be large, given the small area of the slip-prevention blade lower extremities.

If the bias spring 64 is not strong enough to push the top plate 62 away from the top of the top surface 70 of the space 52, when the wearer's weight is on the guard 10, then the dual-blade unit 56 may in certain embodiments "collapse" with spring 64 and top plate 62 pushed/collapsed against the top surface 70 (not shown). Still, the blades 71, 72 may still function to bite into the ice for slip-prevention as long as the height dimension of the blades 71, 72 is sufficient, to reach at least slightly beyond the guard plane GP to bite into ice. As will be understood from reading description later in this document, such a "collapsed" dual-blade unit may perform similarly to an un-biased, immovable slip-protection system such as shown in FIGS. 17-21.

Figure 11:
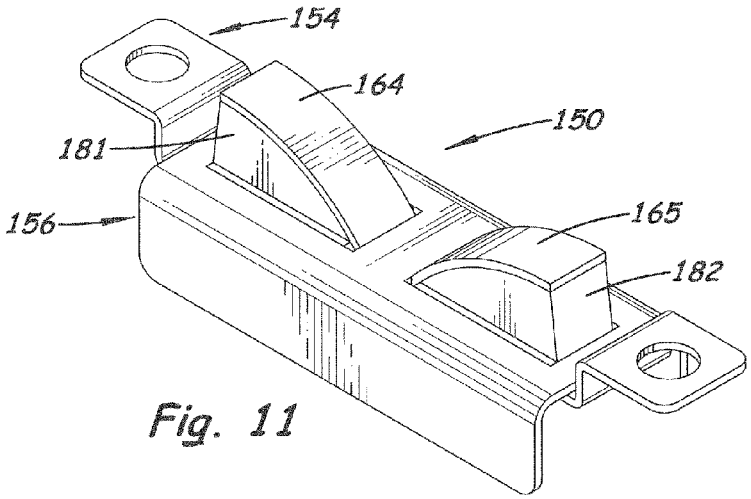
FIG. 11 is a top perspective view of an alternative dual-blade assembly, comprising a two-spring dual-blade unit, two cushions, and a retainer for being connected to the guard by bolts or other fasteners.
Figure 12:
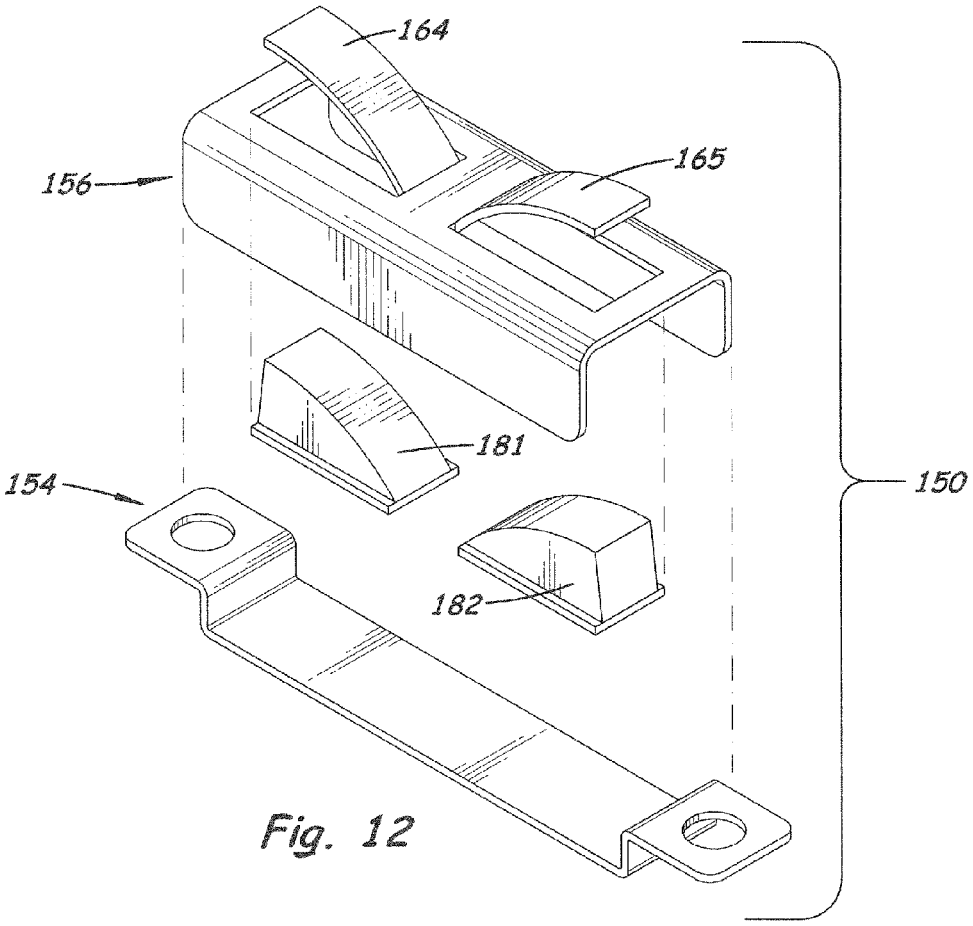
FIG. 12 is an exploded view of the device of FIG. 11.

FIGS. 11 and 12 illustrate an alternative dual-blade assembly 150, wherein the dual-blade unit 156 has two springs 164, 165, which may be leaf-springs, that extend up and outward toward the rear and the front of the unit 156. Two separate cushions 181, 182, which rest on the retainer bracket 154 and protrude up through apertures in the unit 156, are used. Like in dual-blade assembly 50, a retainer bracket 154 supports the dual-blade unit 156 and connects it to the guard main body.

Figure 13:
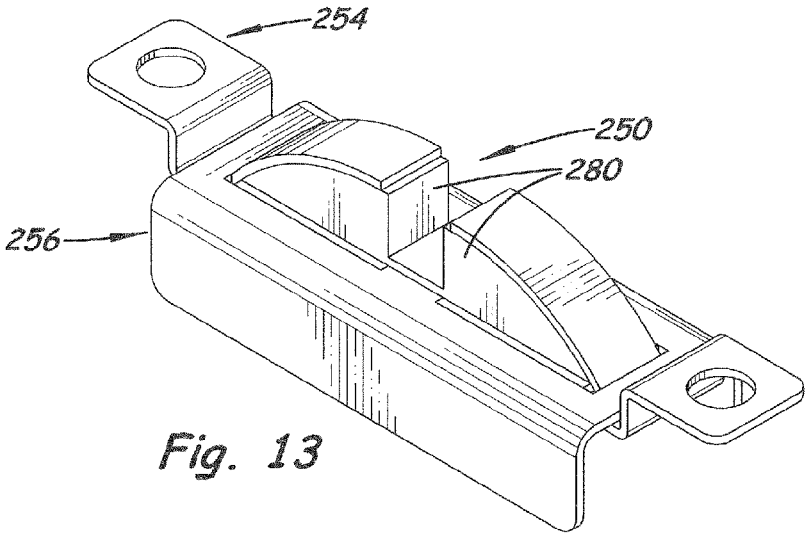
FIG. 13 is a top perspective view of yet another alternative dual-blade assembly, comprising a two-spring dual-blade unit wherein the springs extend toward each other, two cushion portions of a single cushion unit, and a retainer for being connected to the guard by bolts or other fasteners.
Figure 14:
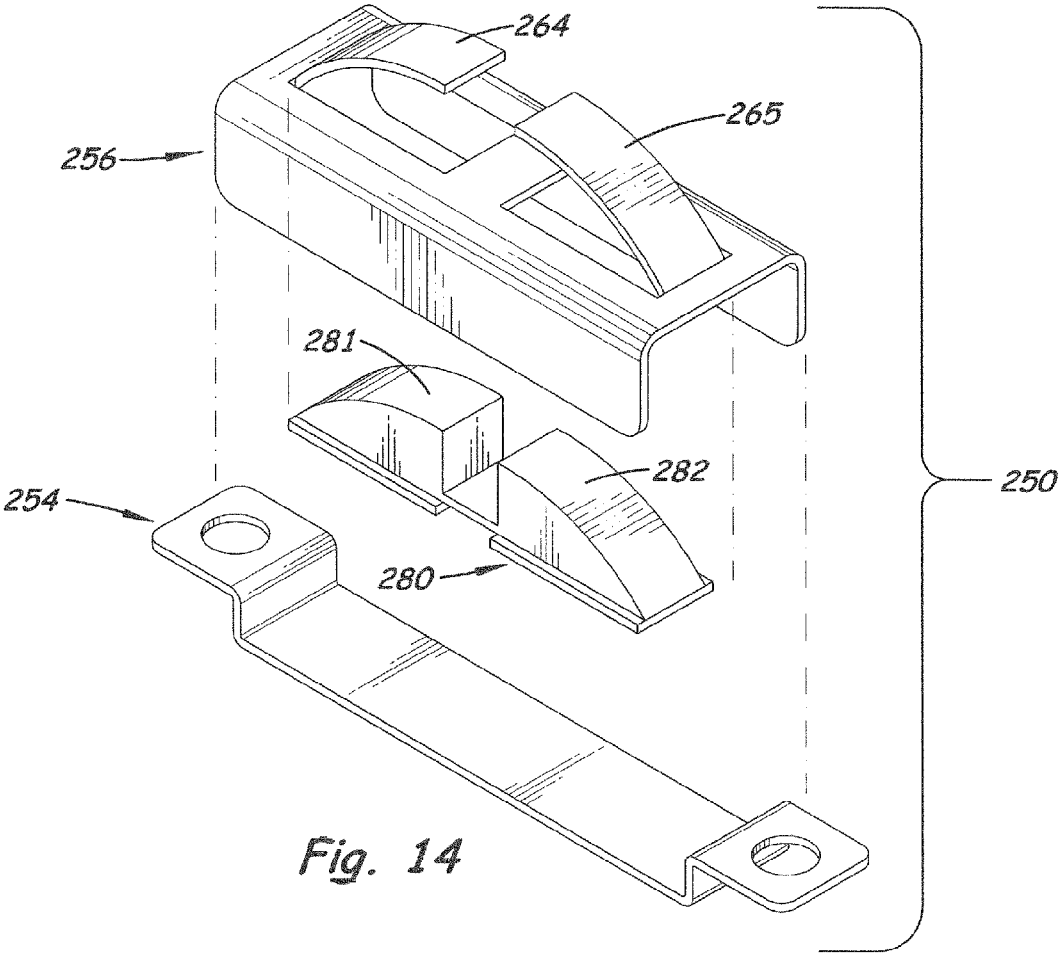
FIG. 14 is an exploded view of the device of FIG. 13.

FIGS. 13 and 14 illustrate an alternative dual-blade assembly 250, wherein the dual-blade unit 256 has two springs 264, 265 that extend up and generally toward the center of the unit 256. A single cushion unit 280 having two cushion portions 281, 282 rests on the retainer bracket 254 so that the cushion portions 281, 282 protrude up through apertures in the unit 256. Like in dual-blade assemblies 50 and 150, a retainer bracket 254 supports the dual-blade unit 256 and connects it to the guard main body.

Figure 15:
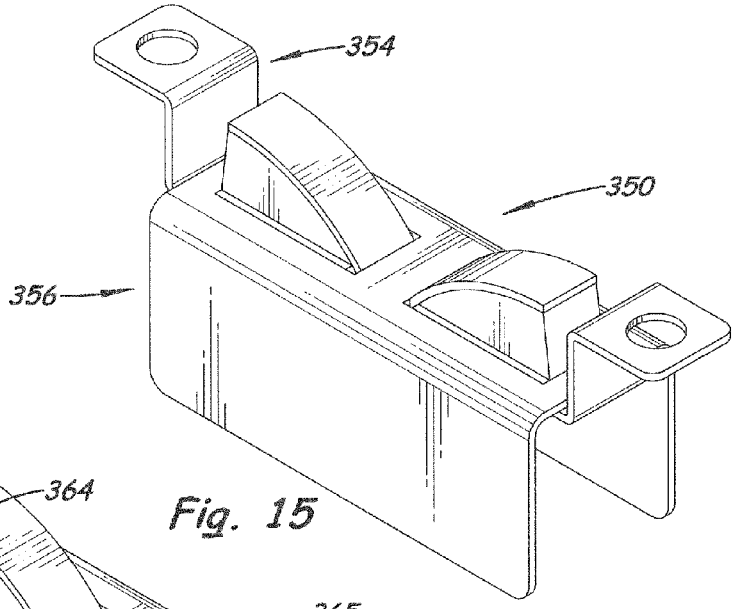
FIG. 15 is a top perspective view of yet another alternative dual-blade assembly, similar to that in FIGS. 11 and 12, except that the relative dimensions of the dual-blade unit and the retainer have been altered, as may be useful depending on the dimensions of the skate guard body, and/or to maintain the two blades in a more exposed position for better contact with, and biting into, the ice during incipient sideways movement.
Figure 16:
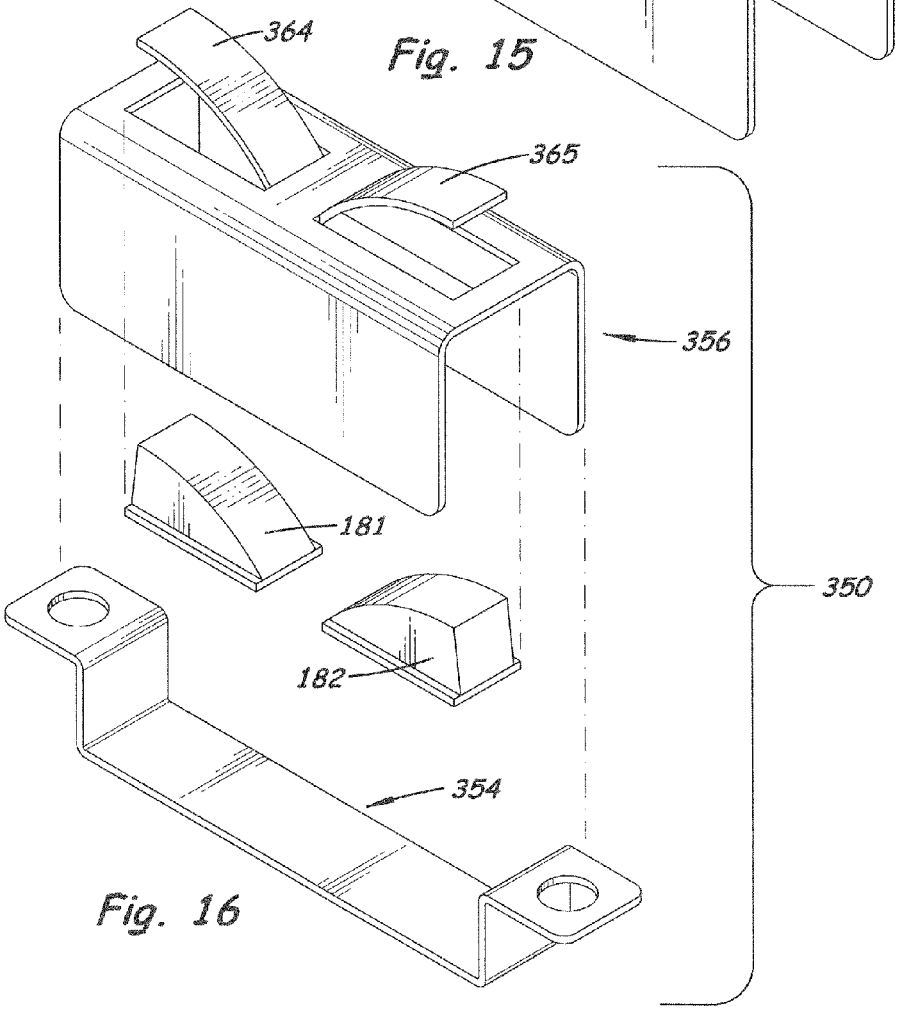
FIG. 16 is an exploded view of the device of FIG. 15.
Figure 17:
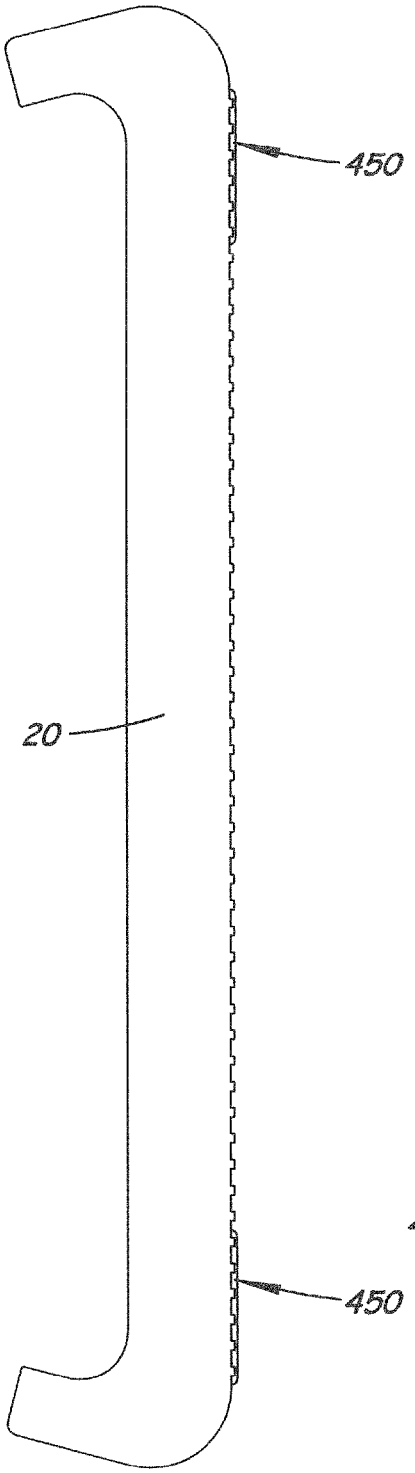
FIG. 17 is a side view of an example blade guard with an alternative slip-prevention system, installed near the toe and near the heel of the blade guard, that is one embodiment of a fixed slip-prevention system that does not move relative to the guard body.
Figure 18:
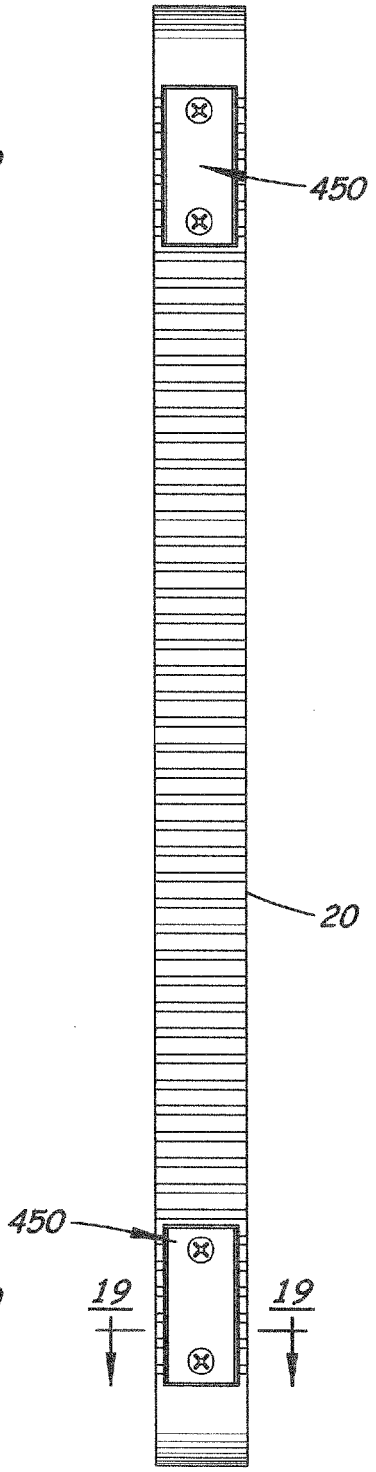
FIG. 18 is a bottom view of the embodiment of FIG. 17.
Figure 19:
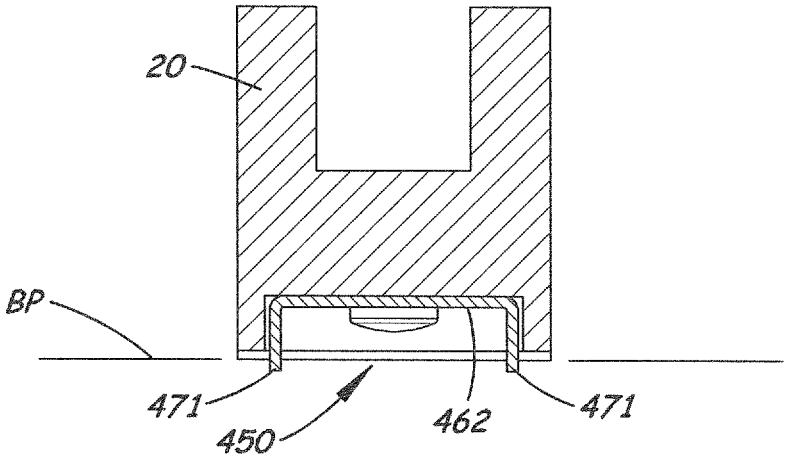
FIG. 19 is a cross-sectional end view of the embodiment of FIGS. 17 and 18, viewed along the line 19-19 in FIG. 18.
Figure 20:
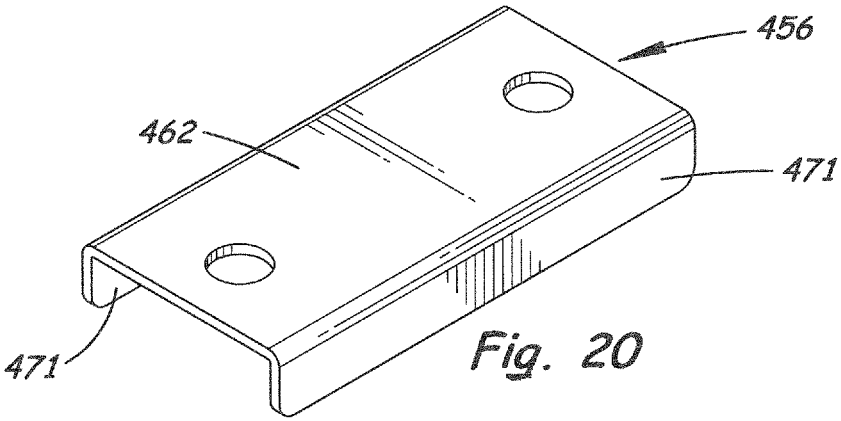
FIG. 20 is a top perspective view of the dual-blade member of the embodiment of FIGS. 17-19.
Figure 21:
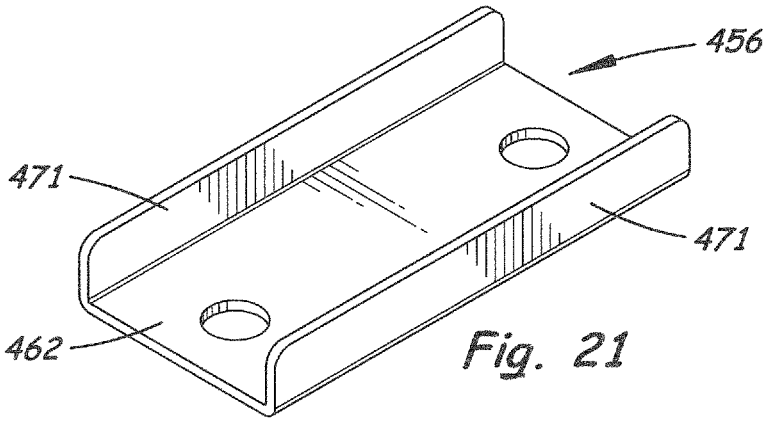
FIG. 21 is a bottom perspective view of the dual-blade member of the embodiment of FIGS. 17-20.
Figure 22:
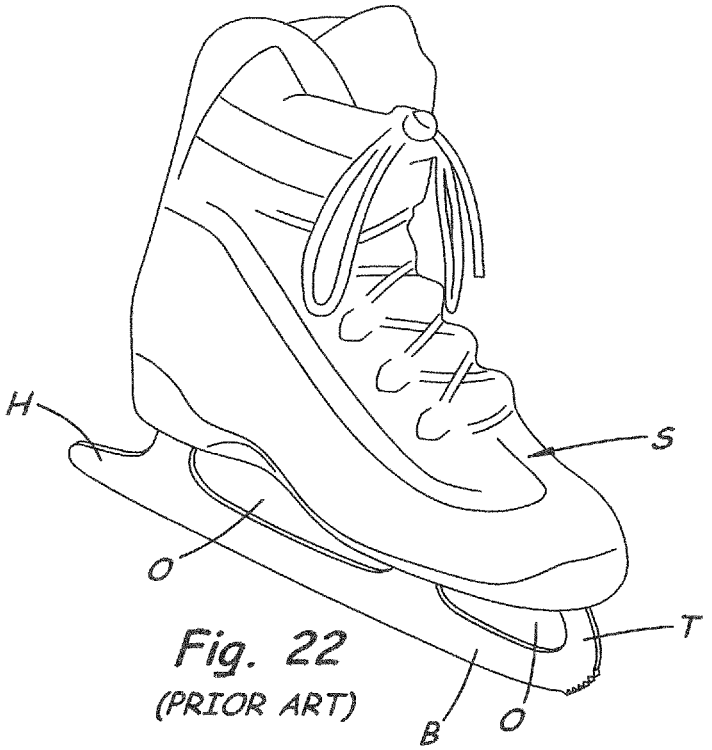
Fig. 22 (PRIOR ART)
FIG. 22 is a perspective view of one example of a conventional ice skate.
Figure 23:
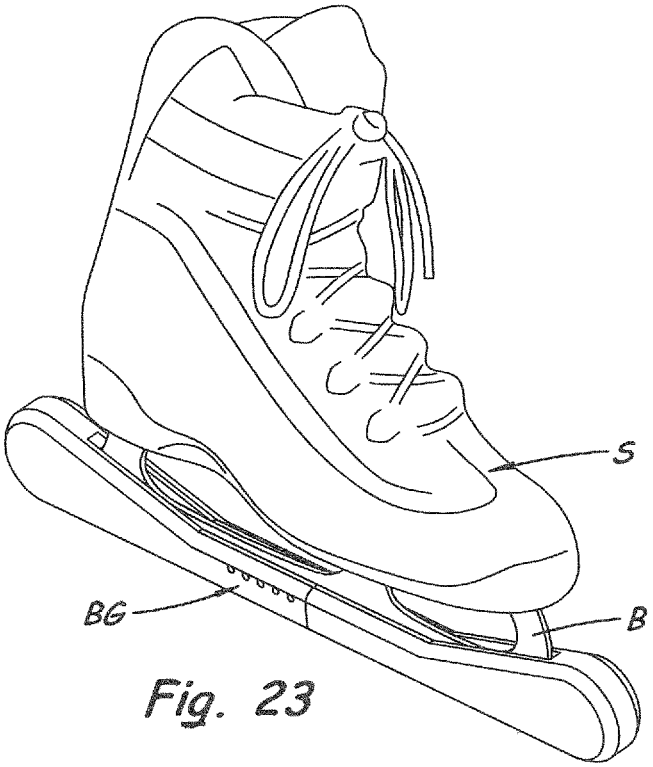
FIG. 23 is a perspective view of the ice skate of FIG. 22 with one example blade guard main body installed on the ice skate, wherein the main body may have an embodiment of the slip-prevention system installed on its bottom surface but not visible in this view.

FIGS. 15 and 16 illustrate an alternative dual-blade assembly 350, much like assembly 150 in FIGS. 11 and 12, except that certain dimensions relative to others are changes. Specifically, the height of the retainer bracket 354 is greater than that of bracket 154, and the height of the blades is greater than that of blades in assembly 150. This illustrates certain, but not all, alterations that may be done to fine-tune slip-performance system performance, for example, to ensure the dual-blade unit will be stable and reliable in/on the guard and will contact and bite into the ice. The dual-blade unit 356 has two springs 364, 365 that extend up and rearward and forward. Two cushions 381, 382 rest on the retainer bracket 354 and protrude up through apertures in the unit 356. Like in dual-blade assemblies 50, 150, and 250, retainer bracket 354 supports the dual-blade unit 356 and connects it to the guard main body.

In many embodiments, such as slip-prevention systems 50, 150, 250, 350, wherein the blade units/blades are biased downward from the guard main body, it may be understood that the bias may be provided by various means other than those shown. For example, a spring(s), cushion(s), and/or or other bias member(s) may be attached/connected to the guard main body rather than to the blade unit/blade, to be "carried" by the main body (such as the top wall of a recess in the main body) while lying between the main body and the blade unit/blade. Or, a spring(s), cushion(s), and/or or other bias member(s) may be placed between the main body and the blade unit/blade but not attached or fixed to either, for example, received in a portion of the recess in the main body and retained by the recess walls on the top and sides and the blade unit/blade below.

An alternative slip-prevention system 450, shown in FIGS. 17-21, is one but not the only embodiment that is non-biased and non-moving relative to the guard. A duel-blade unit (or "channel member") 456 has a horizontal plate 462 and two spaced blades 471, 471' depending down from the outer longitudinal edges of the horizontal plate 462. The dual-blade unit may be noted to be similar to the dual-blade units 56, 156, 256, 356, but without the bias springs and without apertures except for fasteners. The dual-blade unit is fixed to the bottom of the guard, via said fasteners, preferably with the horizontal plate and heads of fasteners in a recess in the guard so that only the dual blades reach and depend beyond/below the guard plane GP. The depending blades may also be partly or substantially in the recess, but the lowermost extremities are exposed below the guard panel GP to an extent that they bite into the ice upon incipient sideways movement. One may expect these non-movable slip-prevention blade(s) to protrude beyond the guard plane GP a distance in the range of 1/64-1/2, 1/64-1/4, 1/32-1/4, 1/32-1/16 inch, or about 1/16 inch, for example.

Therefore, the dual-blade unit 456 works similarly to units 56, 156, 256, 356, except unit 456 is not slidable in the guard and is not biased. Unit 456 is bolted or otherwise fixed to the guard, and does not move relative to the guard, and so the dimensions of the unit 456, the sharpness or thinness of the depending blades, may be important for ensuring they bite properly into the ice without stopping or tripping-up the forward motion. The blades, as in units 56, 156, 256, and 356 may be spaced apart by 50-120 percent of the width of the bottom of the guard, for example. More preferably, they are spaced apart by about 70-95 percent of the width of the bottom surface of the guard, so a portion of the guard extends outside and along the blades, for reinforcing or retaining the blades on the guard and in a recess. The depending blades are rigid, non-pivoting, non-compressible. When the wearer walks on non-ice surfaces, or enters the ice, the wearer, skate and guard will typically be supported by the blades, rather than the bottom surface of the guard, and said blades will prevent slipping as discussed above for other embodiments. Such non-movable embodiments may wear sooner than slidable/movable ones, but still may be effective and economical, especially as this slip-prevention system preferably has no moving parts.

FIGS. 24-33 illustrates alternative slip-prevention systems that have features and uses in common with those of FIGS. 1-21, and it will be understood how the discussion above applies to the embodiments of FIGS. 24-33, and how details discussed above may be combined with the features specifically shown in FIGS. 24-33 and discussed below. FIGS. 24-33 particularly illustrate how alternative blades units/blades may be used in slip-prevention systems, for example, blades at various angles to the guard plane GP, blades of various numbers, positions, and locations on the guard, and blades of various shapes.

Figure 24:
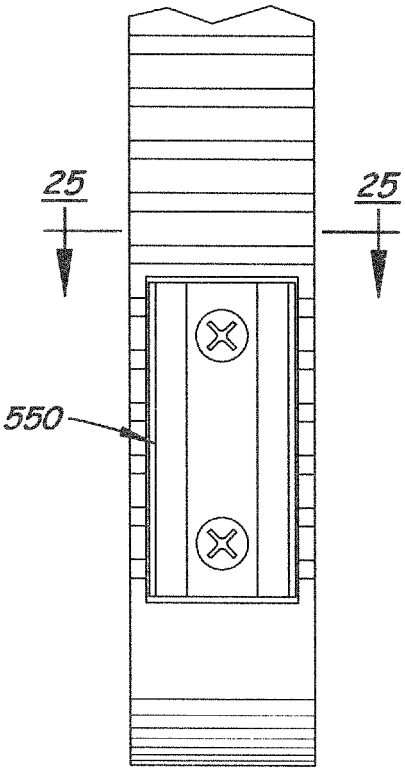
FIG. 24 is a bottom view of an alternative embodiment of a slip-prevention system on a skate guard main body, featuring a blade unit that has two downwardly-depending blades that are each at an obtuse angle relative to the top plate of the blade unit and the guard plane, and wherein this blade unit is another embodiment of a fixed slip-prevention system that does not move relative to the guard body.
Figure 25:
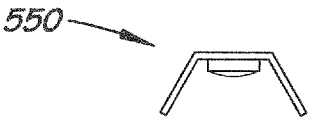
FIG. 25 is an end view of only the blade unit (with fasteners) of FIG. 25, viewed from the line 25-25 in FIG. 24.

FIGS. 24 and 25 illustrate a slip-prevention embodiment wherein a blade unit 550 includes two downwardly-depending blades that each are at a non-perpendicular angle relative to the top plate of the blade unit and relative to the guard plane GP that may be called "horizontal", and hence may be called "non-vertical" blades. The two blades are not parallel to each other, extending away from each other, each at an obtuse angle to the top plate of the blade unit and the guard plane. For example, the obtuse angle of each blade may be in the range of 91-160 degrees or 91-135 degrees, for example, from the guard plane GP. The blade unit 550 is fastened to the guard main body preferably in a recess, so that the blade unit and its fasteners are recessed in the main body and do not contact the ice. The blade unit 550 is shown as a fixed, non-movable system, fastened to the main body by two fasteners, but one of skill in the art will understand that non-vertical blades may be used in a biased, moving slip-prevention system.

Figure 26:
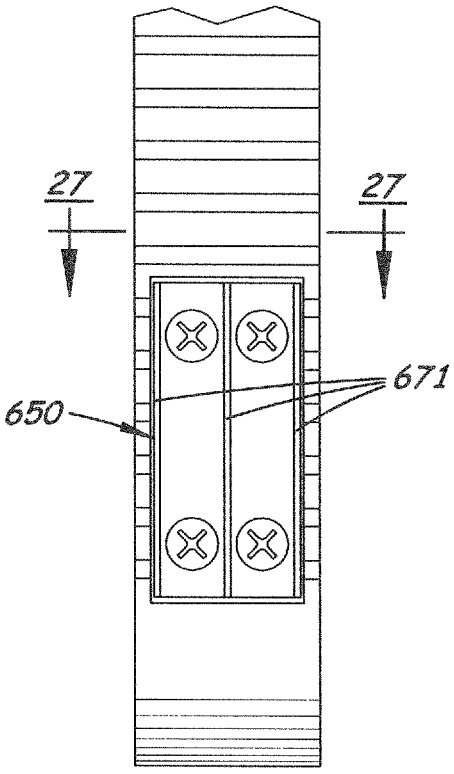
FIG. 26 is a bottom view of an alternative embodiment of a slip-prevention system on a skate guard main body, and featuring a blade unit that has three downwardly-depending blades that are each at a right angle relative to the top plate of the blade unit and the guard plane, wherein this blade unit is another embodiment of a fixed slip-prevention system that does not move relative to the guard body.
Figure 27:
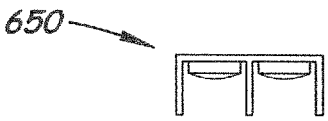
FIG. 27 is an end view of only the blade unit (with fasteners) of FIG. 26, viewed from the line 27-27 in FIG. 26.

FIGS. 26 and 27 illustrate a slip-prevention embodiment wherein a blade unit 650 includes three downwardly-depending blades 671 that each are at a perpendicular angle relative to the top plate of the blade unit and relative to the "horizontal" guard plane GP, and hence may be called "vertical" blades. The three blades extend parallel to each other, each at 90 degrees or about 90 degrees to the top plate of the blade unit and the guard plane GP. The blade unit 650 is fastened to the guard main body preferably in a recess, so that the blade unit and its fasteners are recessed in the main body and do not contact the ice. The blade unit 650 is shown as a fixed, non-movable system, fastened to the main body by four fasteners, but one of skill in the art will understand that blade units with more than two blades may be used in a biased, moving slip-prevention system. Three blades are shown as an example of "more than two blades" in a blade unit, but more or fewer may be used in certain embodiments.

Figure 28:
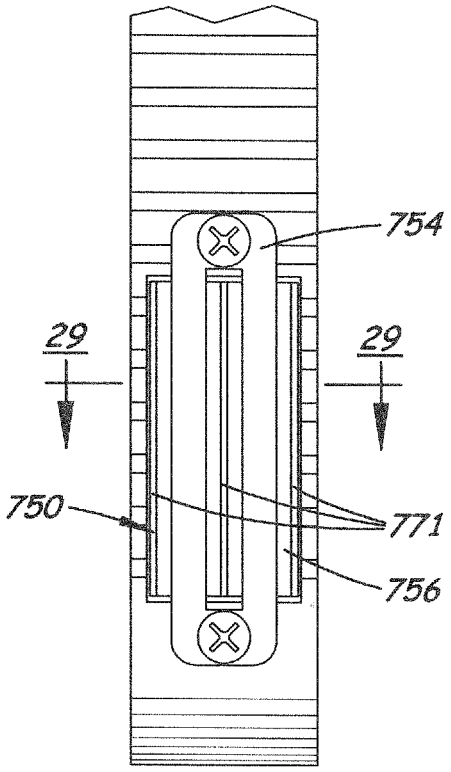
FIG. 28 is a bottom view of an alternative embodiment of a slip-prevention system on a skate guard main body, featuring a blade unit that has three downwardly-depending blades that are each at a right angle relative to the top plate of the blade unit and the guard plane, and also featuring a bracket fastened to the main body and extending across and below the blade unit to hold the blade unit on the skate guard main body, for example, in a recess in the main body wherein the blade unit may slide up and down relative to the recess.
Figure 29:
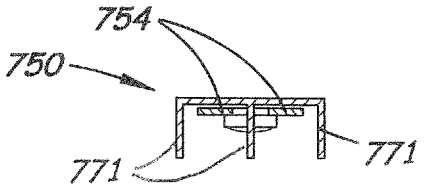
FIG. 29 is an end view of only the blade unit and bracket (with fasteners) of FIG. 28, viewed from the line 29-29 in FIG. 28.

FIGS. 28 and 29 illustrate a slip-prevention embodiment wherein a blade unit 750 includes three downwardly-depending blades 771 that each are at a perpendicular angle relative to the top plate 756 of the blade unit and relative to the bottom plane (guard plane GP) of the main body of the skate guard, and hence may be called "vertical" blades. The three blades extend parallel to each other, each at 90 degrees or about 90 degrees to the top plate 756 of the blade unit and the guard plane. The blade unit 750 is shown as a movable system that may be understood to include a bias system such as spring(s), cushion(s) and/or other bias elements, not shown in FIGS. 28 and 29 but discussed above for other embodiments. The blade unit 750 is connected to the main body by a bracket 754 that is fastened preferably in a recess in the main body of the guard, so that the bracket 754 and its fasteners, and the top plate 756, are recessed in the main body and do not contact the ice. Three blades are shown as an example of "more than two blades" in a blade unit, but more or fewer may be used in certain embodiments. Also, other brackets and fasteners may be used to connect the moving, biased blade(s) to the guard.

Figure 30:
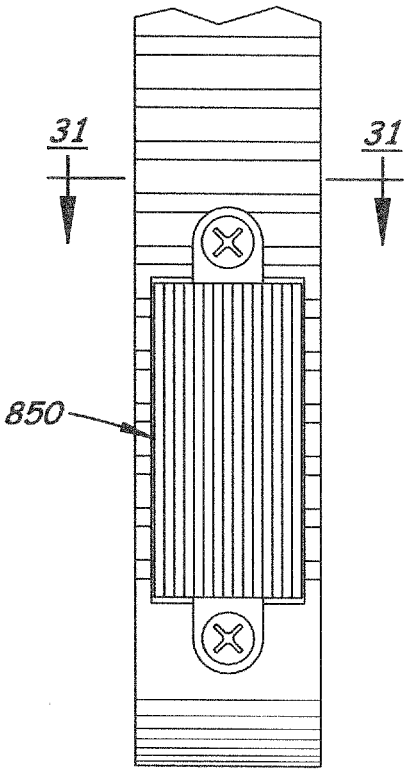
FIG. 30 is a bottom view of an alternative embodiment of a slip-prevention system on a skate guard main body, and featuring a blade unit that has many downwardly-depending protrusions/ridges, wherein this blade unit is another embodiment of a fixed slip-prevention system that does not move relative to the guard body.
Figure 31:
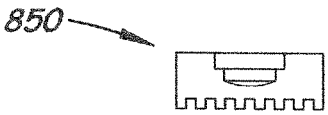
FIG. 31 is an end view of only the blade unit (with fasteners) of FIG. 30, viewed from the line 31-31 in FIG. 30.

FIGS. 30 and 31 illustrate a slip-prevention embodiment wherein a blade unit 850 includes many downwardly-depending blades that take the form of many longitudinal protrusions or ridges. The protrusions depend parallel to each other and perpendicularly from a block or plate, at or generally at 90 degrees to the block or plate, and bottom of the guard (guard plane GP). Alternatively, the longitudinal protrusions may protrude at non-perpendicular (non-vertical) angles. The blade unit 850 is shown as a fixed, non-movable system, fastened to the main body by two fasteners, but one of skill in the art will understand that blade units with many blades may be used in a biased, moving slip-prevention system. The blade unit 850 should be recessed sufficiently, and preferably curved/rounded at least at its forward end, so that the front end of the blade unit 850 does not stop or trip-up forward motion. Eight blades are shown as an example of "more than two blades/protrusions/ridges" or "many blades/protrusions/ridges" in a blade unit, but more or fewer more may be used in certain embodiments.

Figure 32:
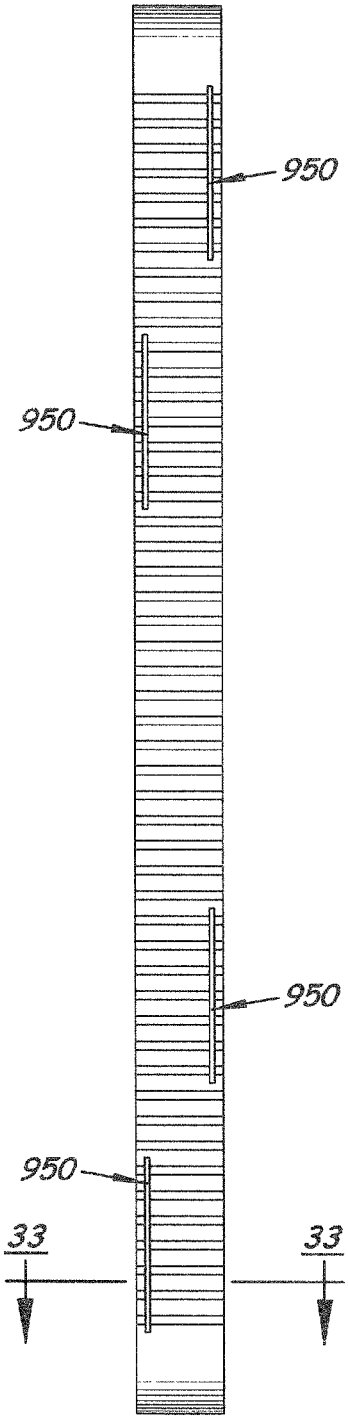
FIG. 32 is a bottom view of an alternative slip-prevention system on a skate guard main body, which comprises multiple blade units that each comprise only a single blade connected to the main body of the skate guard, and wherein such blade units are another embodiment of a fixed slip-prevention system that does not move relative to the guard body.
Figure 33:
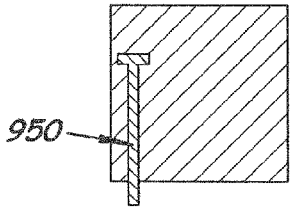
FIG. 33 is a cross-sectional view of one of the single blades and main body of FIG. 32, showing how the blade may be connected to the main body, for example, by its top end being embedded in the main body.

FIGS. 32 and 33 illustrate a slip-prevention embodiment wherein each blade unit 950 includes a single downwardly-depending blade, and wherein the blades are spaced apart along the length of the guard and alternate near opposite sides of the guard. These blades are shown as being "vertical" blades, that is, perpendicular to the "horizontal" guard plane GP, but certain embodiments may include all or some non-vertical blades, for example, blades at obtuse angles to the "horizontal" guard plane GP. In FIG. 32, the single-blade blade units 950 are parallel to each other, with two at the ends of the guard and two nearer the middle, including two at or near the right side edge of the guard and two at or near the left side edge of the guard. The blade units 950 are shown as fixed, non-movable systems, fixed to the main body by being embedded in the guard main body, as shown in FIG. 33; other means of fixing or fastening the single-blade units may be used.

It may be noted that the one or more longitudinally-extending bar, blade, protrusion, ridge, or other longitudinally-extending member may each have curved, radiused, or rounded ends, for example, as shown the radiused/rounded front and rear lower ends of blades of systems 50, 150, 250, 350, and 450. This will help smooth forward movement when the user goes upon the ice and help prevent the blades from "catching" and the wearer tripping/falling forward.

Therefore, the one or more, or many, longitudinally-extending bar(s), blade(s), protrusion(s), ridge(s), or other member longitudinally-extending member may be provided in various forms, combinations, angles, positions, and motions (movable and biased, or non-movable and non-biased, for example), for biting-into (cut into, grip, engage) or otherwise interacting with the ice to limit or stop sideways motion. "One or more" longitudinally-extending members may include, for example, 1-20, 1-10, 1-5, 1-3, or any number within those ranges, with the spacing between said one or more members preferably large enough to allow individual of said members to bite into the ice sufficiently to stop the side-ways sliding. Also, the longitudinally-extending member(s) may protrude down from the guard main body at various angles including 90 degrees or more from the bottom plane of the guard main body; therefore, one may say said member(s) may extend straight down (90 degrees) or at more than 90 degrees, for example, 91-160 degrees or 91-135 degrees from the guard plane GP, so from 90 to 160 degrees or 90 to 135 degrees from the guard plane GP, for example. An important feature of many or all embodiments is that transversely-extending bar(s), blade(s), protrusion(s), ridge(s), or other transverse members on the guard, that might contact and catch on/in the ice when the wearer goes onto the ice, are minimized or prevented, except possibly the non-sharp polymeric ridges 26 extending downward on each side of the channels 24 (see FIG. 1) of a conventional guard. The longitudinally-extending member(s), in many embodiments, are made of durable metal and will have a thickness and/or reinforcement that will result in long effective use. Many conventional skate guard designs may be adapted to include embodiments of the invented slip-prevention system, and the adaptations may in many embodiments comprise the addition of one or more metal elements to/in the polymeric bottom of the guard. Alternatively, skate guards may be made according to certain embodiments wherein the longitudinally-extending members are manufactured integrally in/on the skate guard main body, and do not necessarily in all embodiments need to be of different materials than the main body. Also, alternatively, skate guards with wider-than-conventional guard main bodies may be provided to accept/fit higher numbers or thicker longitudinally-extending member(s)/adaptations in the bottom surface of the guard.

Certain embodiments may be described as: An ice skate blade guard for limiting or preventing sideways slipping when the guard remains on a skate when a wearer goes onto the ice, the ice skate blade guard comprising: an elongated main body with a front end, a rear end, a right side and a left side, and a longitudinal axis between the front end and rear end, the main body further having a lowermost surface lying on a guard plane, and an interior longitudinal space with a top opening for receiving at least a portion of a skate blade for protecting the skate blade; and a slip-prevention system connected to the main body and comprising at least one elongated member extending longitudinally along the main body, wherein a portion of the at least one elongated member extends below said guard plane for biting into ice at or near beginning of movement of the guard on the ice transverse to the length of the main body; wherein said at least one elongated member has smooth longitudinally-extending right and left sides for smooth forward movement on the ice. The main body may be made of polymeric material and said at least one elongated member may be made of metal. The at least one elongated member may have a sharp single bottommost edge, or a sharp right bottom edge and a sharp left bottom edge, for example. The at least one elongated member may be and preferably is permanently attached to the main body. Preferably, none of the at least one elongated member (and preferably none of said members if there are plural) extends right past the right side of the main body and none of the at least one elongated member (and preferably none of said members if there are plural) extends left past the left side of the main body. Preferably, the at least one elongated member (and preferably all of said members if there are plural) is smaller in width than the main body, and none of the at least one elongated members (preferably none of said members if there are plural) extends out past the right side of the main body and none of the at least one elongated members (preferably none of said members if there are plural) extends out past the left side of the main body. Preferably, the at least one elongated member (and preferably all of said members if there are plural) has an upper end that extends up into the bottom surface of the main body and none the at least one elongated member (and preferably none of said members if there are plural) extends out and around the right side or the left side of the main body.

Certain other embodiments may be described as: An ice skate blade guard adapted for limiting or preventing falls, the guard comprising an elongated main body having a generally planar bottom surface with a length and a transverse width, and an interior longitudinal space with a top opening for receiving at least a portion of a skate blade for protecting the skate blade; wherein the improvement comprises at least two elongated blades depending from the bottom surface of the main body and having lengths parallel to the length of the bottom surface, said blades being longitudinally smooth so that safe forward movement on the ice occurs if the wearer fails to remove the guard before entering the ice, and said blades each having a transverse thickness that is less than ⅕ of the transverse width of said bottom surface so that the blades are adapted to bite into the ice upon incipient transverse movement of the guard relative to the ice, whereby the guard and skate will be limited or prevented from sliding sideways on the ice out from under the wearer to cause a fall.

Although this disclosure includes description with reference to particular means, materials and embodiments, it is to be understood that the invention is not limited to these disclosed particulars, but extends instead to all equivalents within the scope of the following claims.

The invention claimed is:

1. An ice skate blade guard for limiting or preventing sideways slipping when the guard remains on a skate when a wearer goes onto the ice, the ice skate blade guard comprising:

an elongated main body with a front end, a rear end, a right side and a left side, and a longitudinal axis between the front end and rear end, the main body further having a lowermost surface lying on a guard plane, and an interior longitudinal space with a top opening for receiving at least a portion of a skate blade for protecting the skate blade; and a slip-prevention system connected to the main body and comprising at least one elongated member extending longitudinally along the main body, wherein a portion of the at least one elongated member extends below said guard plane for biting into ice at or near beginning of movement of the guard on the ice transverse to the length of the main body;

wherein said at least one elongated member has smooth longitudinally-extending right and left sides for smooth forward movement on the ice.

2. The ice skate blade guard as in claim 1, wherein the main body is made of polymeric material and said at least one elongated member is made of metal.

3. The ice skate blade guard as in claim 1, wherein the at least one elongated member has a sharp single bottommost edge.

4. The ice skate blade guard as in claim 1, wherein the at least one elongated member has a sharp right bottom edge and a sharp left bottom edge.

5. The ice skate blade guard as in claim 1, wherein the at least one elongated member is permanently attached to the main body.

6. The ice skate blade guard as in claim 1, wherein none of the at least one elongated member extends right past the right side of the main body and none of the at least one elongated member extends left past the left side of the main body.

7. The ice skate blade guard as in claim 1, wherein the at least one elongated member is smaller in width than the main body and does not extend out past the right side of the main body and does not extend out past the left side of the main body.

8. The ice skate blade guard as in claim 1, wherein the at least one elongated member has an upper end that extends up into the bottom surface of the main body and the at least one elongated member does not extend out and around the right side or the left side of the main body.

9. The ice skate blade guard as in claim 1, wherein said at least one elongated member comprises multiple blades depending side-by-side from the main body, and wherein one of said multiple blades depends down at or near said right side of the main body and one of said multiple blades depends down at or near said left side of the main body.

10. The ice skate blade guard as in claim 1, wherein said at least one elongated member comprises a multiple-blade unit having a main plate generally parallel to said bottom surface of the main body and multiple parallel slip-prevention blades extending down from the main plate.

11. The ice skate blade guard as in claim 1, wherein said at least one elongated member comprises a multiple-blade unit having a main plate generally parallel to the bottom surface of the main body and multiple non-parallel slip-prevention blades extending down from the main plate.

12. The ice skate blade guard as in claim 1, wherein the at least one elongated member is slidably mounted in a recess in the bottom surface and is biased to slide downward relative to the main body.

13. The ice skate blade guard as in claim 1, wherein the at least one elongated member is fastened to the main body in a recess in the bottom surface, and the at least one elongated member is not moveable relative to the main body.

14. The ice skate blade guard as in claim 12, wherein the at least one elongated member is biased to slide downward by at least one bias element selected from the group consisting of: a spring, springs, a cushion, cushions, and a combination of two or more of said bias elements.

15. The ice skate blade guard as in claim 1, wherein said at least one elongated member has at least one sharpened bottom edge for said biting into the ice at or near beginning of movement of the guard on the ice transverse to the length of the main body.

16. The ice skate blade guard as in claim 15, wherein said at least one elongated member has a curved, radiused, or rounded front lower end for said smooth forward movement on the ice.

17. The ice skate blade guard as in claim 1, wherein said main body has a thickness between said right side and said left side, and said at least one elongated member has right side, a left side, and a thickness from the right side to a left side, and the at least one elongated member thickness is in the range of ⅕-1/20 of the thickness of the main body.

18. An ice skate blade guard adapted for limiting or preventing falls, the guard comprising an elongated main body having a generally planar bottom surface with a length and a transverse width, and an interior longitudinal space with a top opening for receiving at least a portion of a skate blade for protecting the skate blade;

wherein the improvement comprises at least two elongated blades depending from the bottom surface of the main body and having lengths parallel to the length of the bottom surface, said blades being longitudinally smooth so that safe forward movement on the ice occurs if the wearer fails to remove the guard before entering the ice, and said blades each having a transverse thickness that is less than ⅕ of the transverse width of said bottom surface so that the blades are adapted to bite into the ice upon incipient transverse movement of the guard relative to the ice, whereby the guard and skate will be limited or prevented from sliding sideways on the ice out from under the wearer to cause a fall.

19. The ice skate blade guard as in claim 18, wherein multiple of said at least two elongated blades are provided as a multiple-blade unit biased to move downward away from the main body of the guard for biting into the ice.

20. The ice skate blade guard as in claim 19, wherein the multiple-blade unit is biased to move downward by a bias element selected from the group consisting of: a spring, springs, a cushion, cushions, and a combination of two or more of said bias elements.

21. The ice skate blade guard as in claim 18, wherein multiple of said at least two elongated blades are provided as a multiple-blade unit fixed, and immovable relative, to said broad bottom surface.

22. The ice skate blade guard as in claim 18, wherein the main body is made of polymer material and said at least two elongated members are metal.

23. The ice skate blade guard as in claim 18, wherein said at least two elongated members comprise multiple blades depending side-by-side from the main body, and wherein one of said multiple blades depends down at or near said right side of the main body and one of said multiple blades depends down at or near said left side of the main body.

* * * * *